United States Patent [19]

Swaniger

[11] 4,038,941

[45] Aug. 2, 1977

[54] ENVELOPE FLAP MOISTENER

[75] Inventor: James R. Swaniger, Bridgeport, Conn.

[73] Assignee: Pitney-Bowes, Inc., Stamford, Conn.

[21] Appl. No.: 726,640

[22] Filed: Sept. 27, 1976

[51] Int. Cl.[2] ..... B05C 1/02

[52] U.S. Cl. ..... 118/243; 118/260; 156/442.2

[58] Field of Search ..... 118/32, 3, 243, 260, 118/263, 259; 156/441.5, 442.1, 442.2

[56] References Cited

U.S. PATENT DOCUMENTS

| | | | |
|---|---|---|---|
| 1,714,620 | 5/1929 | Poor | 118/243 X |
| 2,793,610 | 5/1957 | Smull | 118/259 |
| 3,948,216 | 4/1976 | Reed et al. | 118/257 |

*Primary Examiner*—John P. McIntosh

*Attorney, Agent, or Firm*—Robert S. Salzman; William D. Soltow, Jr.; Albert W. Scribner

[57] ABSTRACT

An apparatus for moistening the gummed section of an envelope flap for the purpose of sealing the flap to the body of the envelope, is disclosed. The apparatus comprises a reservoir containing a moistening fluid. An endless belt movably conveys the moistening fluid from the reservoir past a window. A bead chain apparatus projects through the window to obtain the moisture carried by the moving belt. An envelope with a distended flap is caused to move past the bead chain apparatus, causing the envelope flap to be wetted thereby. The bead chain apparatus comprises a snap-in frame, which is easily assembled to the moistening apparatus. When a frame becomes laidened with gum residues, it is removed, and a new frame, supporting fresh moistener beads, is snapped into place.

9 Claims, 4 Drawing Figures

ENVELOPE FLAP MOISTENER

The invention relates to a moistening apparatus, and more particularly to a moistening apparatus for wetting the gummed section of an envelope flap.

BACKGROUND OF THE INVENTION

There are a myriad of envelope flap moisteining devices that have been proposed. Two problems of most concern in this art are:

1. providing a uniform wetting action across the gummed surface of the flap; and
2. dealing with annoying gum residues that build-up and deposit upon moistening equipment.

A prior art system that tried to deal with the first one of the above problems is shown in U.S. Pat. No. 3,948,216; issued Apr. 6, 1976. This previous system involved the wetting of envelope flaps by a moving endless belt. The belt would dip into a reservoir of water as it moved over a closed course. As the envelope continuously dipped into the reservoir, it would pick up the water and carry it away. An envelope flap passing a section of the belt would be moistened as it was fed into engaging contact with the belt.

While the prior system dealt effectively with the uniform wetting aspects, it was still subjected to the build-up of annoying gum residue that necessitated constant or frequent cleaning and/or replacement of the belt and reservoir.

The present invention deals with an improvment over the prior system, wherein the first objective of uniform wetting is carefully maintained, while achieving the second objective of dealing with the gum residues.

SUMMARY OF THE INVENTION

This invention pertains to an envelope flas moistener apparatus. The apparatus comprises a reservoir containing a mointening fluid, such as water. An endless belt movably conveys the moistening fluid from the reservoir past a window. a bead chain apparatus is disposed along an envelope feed path adjacent the window. The bead chain apparatus is springbiased towards the window and the belt. The bead chain apparatus obtains moisture from the moving belt, and deposits it on a gummed section of an envelope flap, as the envelope flap moves between the window and the bead chain apparatus.

The bead chain apparatus comprises a plurality of beaded strings having several mointening beads. The beads are interdigitally arranged with respect to each other upon the frame. This arrangement allows for a uniform wetting of the flap. The several beads (balls) provide sufficient water to the gummed section in one of at least several ways:

a. they rotate as the flap brushes by them, thus exposing a continuous wetting surface to the gummed section.
b. moisture is supplied to the flap from the interstices formed between the balls (within the crevices of the chain links); and
c. the balls (beads) are composed of porous material for the purpose of holding a greater quantity of water.

The frame of the bead chain device is made to easily mount into, or be disassembled from, the moistener system. This allows for easy cleaning of the beads or replacement with a fresh bead device (a new frame is snapped in ).

Most of the gum is imparted to the bead chains, which are easily removed, and very little gum is now carried away by the belt. Thus, the ease of maintaining the system is greatly enhanced, while still maintaining a uniform wetting action for the envelope flap.

It is an object of the present invention to provide an improved envelope flap moistener;

It is another object of this invention to provide an envelope flap moistener that is easily serviced and maintained in good working order:

It is a further object of the invention to provide an envelope flap moistener that is not troubled by annoying gum residue build-up These and other objects of this invention will become more apparent and will be better understood with reference to the following detailed description taken in conjunction with the accompanying drawings, in which.

DETAILED DESCRIPTION

Figures 1, 2, 3, 4:
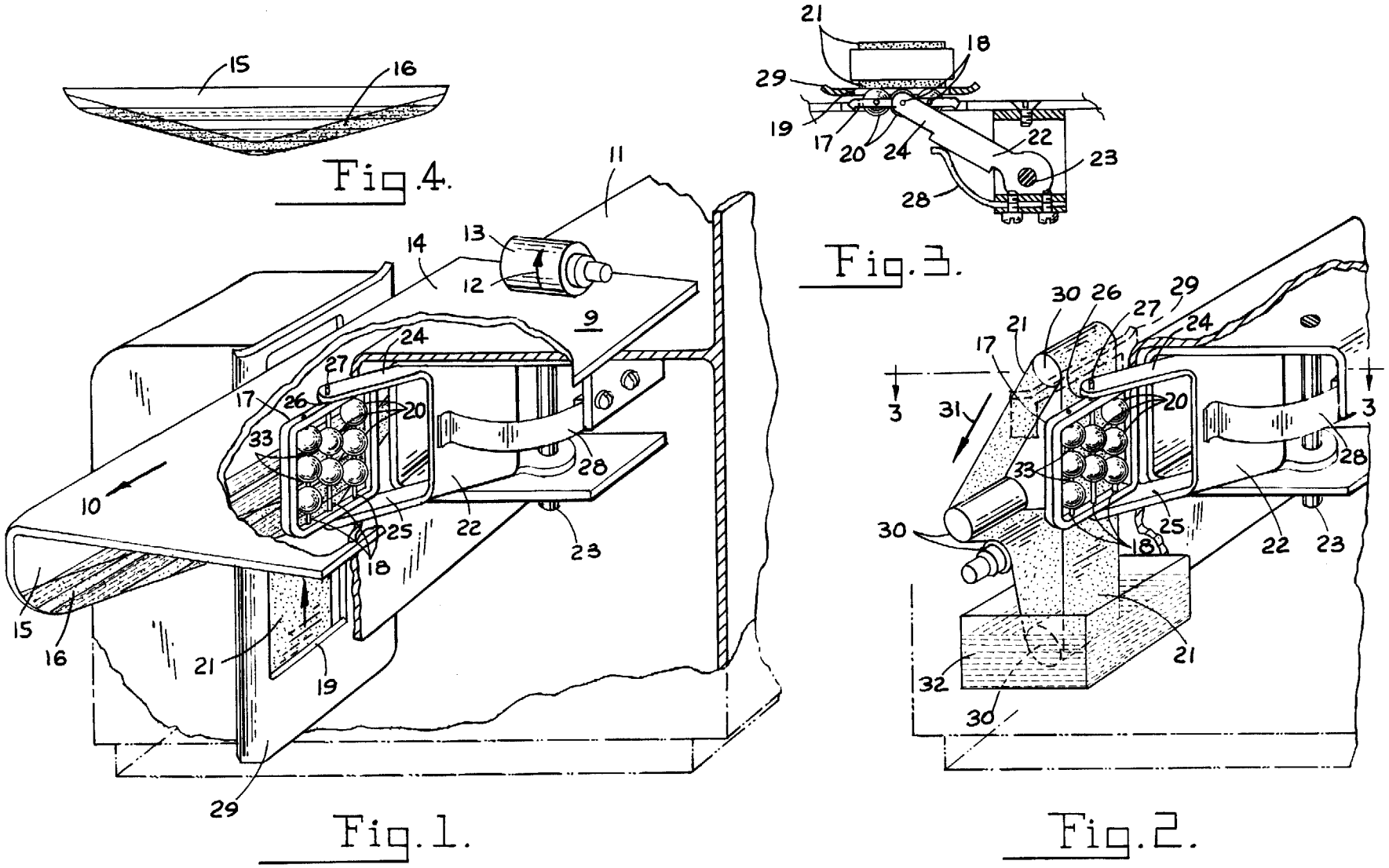
FIG. 1 is a perspective view of an envelope being conveyed through the flap moistening apparatus of this invention.
FIG. 2 is an internal perspective view of the inventive apparatus depicted in FIG. 1.
FIG. 3 is a top view of the inventive apparatus shown in FIG. 2.
FIG. 4 is a front view of a distended envelope flap showing the pattern of moisture deposition provided by the inventive apparatus of FIG. 1.

Now referring to FIG. 1, an envelope 9 is shown being conveyed along (arrow 10) a deck 11. A rotating (arrow 12) roller 13 is sufficient for this purpose.

The envelope 9 has its body portion 14 disposed horizontally upon deck 11, and its flap portion 15 distended downwardly as illustrated. The broad object of the invention is to wet or otherwise moisten the gummed section 16 of flap 15, as the envelope 9 is conveyed over deck 11.

The flap 15 of envelope 9 passes between a bead chain frame 17 containing several beaded strings 18, and a moistening window 19. The moistening window 19 supplies moisture to the beads 20 of the beaded strings 18 via a moistening belt 21, which can be seen in more detail in FIGS. 2 and 3.

The fram 17 is carried by a pivotable support 22, which pivots about shaft 23. The support 22 carries the frame 17 between two arms 24 and 25, respectively. The fram 17 snaps-in to a detented position between arms 24 and 25. This detent, snap-in feature can be accomplished in many ways, consistant with good engineering practice. The drawings illustrate this feature as accomplished by a snap-in shaft 27, which locates in holes 26 disposed on the ends, respectively of each arm 24 and 25. This construction is, of course, merely exemplary of the inventive purpose.

The support 22, and hence, the frame 17 is springbiased toward the window 19 and the wetting belt 21 via spring 28.

The window 19 is formed in frame 29, which also acts as a guide surface for the envelope flap 15 (FIG. 1).

As will be seen from FIG. 2, the endless belt 21 is movably supported upon a series of rollers 30, one of which is a drive roller. the belt is driven in direction 31 as depicted by the arrow (FIG. 2). The movement of the belt 21, allows the belt to continuously draw moistening fluid from the reservoir 32.

OPERATION OF THE INVENTION

The operation of the invention will be explained with particular reference to FIGS. 1 and 4.

The frame 17 and the beads 20 are continuously urged against the moving belt 21, which is constantly being supplied with water from reservoir 32. The beads 20 become coated with the moisture, and the interstices of chain 33 between the beads 20 also attract moisture by surface or capillary attraction. The beads 20 can be made from a water porous material to further the water carrying capabilities of the wetting frame 17.

When the gummed surface 16 of an envelope flap 15 is to be wetted, the envelope 9 is directed along deck 11, as shown by arrow 10. The distended flap 15 of envelope 9 moves between the window 19 and the frame 17. When this happens, the beads 20 rub against the passing envelope flap, and deposit moisture across the flap as substantially shown in FIG. 4. As will be evident from inspection, most of the gummed surface 16 will be wetted as the envelope passed by the beads.

The beads 20 (FIG. 1) will tend to rotate as the flap 15 pushes by them, such that a uniform wetting action occurs.

The wetting frame 17 supplies moisture to the gummed flap in one of at least several ways:

a. The beads (balls) rotate as the flap brushes by them, thus exposing a continuously new wetting surface to the gummed section;

b. moisture is supplied to the flap from the interstices formed between the balls (crevices in the chain links). This provides wetting action between the beads, which produces a more uniform wetting of the gummed surface.

c. the beads are porous to provide a greater supply of moisture to the surface of the beads.

Most of the moisture applied to the flap 15 is in a thin layer provided by the small amount of water disposed upon the surface of the beads. This is a highly desirable type of wetting, since it does not favor the build-up of gum residues on the beads.

However, since residues will eventually be deposited in sufficient quantities with the many uses of the apparatus, the frame 17 can be removed easily for cleaning or replacement.

Having thus described this invention, what is desired to be protected by Letters Patent is presented in the appended claims.

What is claimed is:

1. An envelope flap moistening apparatus, comprising:

a reservoir containing an envelope flap moistening fluid;

means defining an envelope feed path;

transport means for conveying an envelope along said feed path;

a bead chain apparatus disposed along said envelope feed path and having a number of moistener beads for contacting and wetting a gum portion of said envelope, as said envelope is conveyed passed said beads; and wetting means partially disposed within said reservoir and engaging with said bead chain apparatus for conveying said moistening fluid from said reservoir to said bead chain apparatus for wetting said moistener beads, whereby said moistener beads will contain moisture for wetting a passing envelope flap.

2. The envelope moistening apparatus of claim 1, wherein said bead chain apparatus comprises a frame having a plurality of beaded strings each including a number of said moistener beads.

3. The envelope flap moistening apparatus of claim 2, wherein said frame is supported upon a springbiased pivot arm, whereby the moistener beads are urged into positive engagement with said wetting means.

4. The envelope flap moistening apparatus of claim 3, wherein said frame is supported upon said pivot arm by a snap-in connection, whereby a new frame may be easily assembled to said pivot arm when an old frame becomes laidened with gum residues.

5. The envelope flap moistening apparatus of claim 2, wherein each bead chain string is interdigitally disposed with respect to a neighboring bead chain string.

6. The envelope flap moistening apparatus of claim 1, wherein said wetting means comprises an endless moisture absorbing belt that is movably supported, and driven past said bead chain apparatus.

7. The envelope flap moistening apparatus of claim 1, further comprising means defining a window disposed along said envelope feed path between said bead chain apparatus and said wetting means, and wherein said bead chain apparatus is engageable with said wetting means through said window.

8. The envelope flap moistening apparatus of claim 1, wherein said moistener beads are porous, whereby a greater amount of moisture may be deposited upon the gummed portion of the envelope flap.

9. The envelope flap moistening apparatus of claim 1, further comprising biasing means for urging said bead chain apparatus into wetting engagement with said wetting means.

* * * * *